US006059441A

United States Patent [19]

Colin

[11] Patent Number: 6,059,441

[45] Date of Patent: May 9, 2000

[54] PROCESS AND DEVICE FOR SUSPENDING HEAVY PARTICLES OF A SOLID IN A LIQUID

[75] Inventor: Bruno Colin, Marcy l'Etoile, France

[73] Assignee: Bio Merieux, Marcy l'Etoile, France

[21] Appl. No.: 09/180,892

[22] PCT Filed: Mar. 31, 1998

[86] PCT No.: PCT/FR98/00652

§ 371 Date: Nov. 16, 1998

§ 102(e) Date: Nov. 16, 1998

[87] PCT Pub. No.: WO98/43728

PCT Pub. Date: Oct. 8, 1998

[30] Foreign Application Priority Data

Apr. 1, 1997 [FR] France ..... 97 04238

[51] Int. Cl.[7] ..... B01F 13/02

[52] U.S. Cl. ..... 366/101; 366/106

[58] Field of Search ..... 366/101, 106, 366/107; 261/30, 31, 64.1, 64.3, 64.4, 65

[56] References Cited

U.S. PATENT DOCUMENTS

| | | | |
|---|---|---|---|
| 1,668,136 | 5/1928 | Agthe | 366/101 |
| 1,686,076 | 10/1928 | Evans | 366/101 |
| 2,504,009 | 4/1950 | Phillips et al. | 366/101 |
| 3,782,698 | 1/1974 | Canning | 366/101 |
| 4,051,204 | 9/1977 | Muller et al. | 366/101 |
| 5,135,684 | 8/1992 | Mohn et al. | 366/101 |

FOREIGN PATENT DOCUMENTS

| | | | |
|---|---|---|---|
| 0 060 486 | 9/1982 | European Pat. Off. . | |
| 669 864 C | 3/1936 | Germany . | |
| 63-77528 | 7/1988 | Japan . | |
| 1 586 764 | 3/1986 | U.S.S.R. . | |
| 418 349 | 10/1934 | United Kingdom . | |
| 996 195 | 6/1965 | United Kingdom | 366/106 |

*Primary Examiner*—Tony G. Soohoo
*Attorney, Agent, or Firm*—Oliff & Berridge, PLC

[57] ABSTRACT

A device and method for holding a predetermined volume of liquid having suspended particles. The device includes a container for holding the predetermined volume of liquid, the container having a tapered neck and a flat bottom. At least one conduit having a first end extending out a the tapered neck and the second end terminating at the flat bottom is disposed in the container. The conduit defining two chambers communicating with each other through a first passage formed at the bottom of the container and communicating with the atmosphere outside of the container by at least two openings. A pressure in a gas circuit flowing through the device is alternated between a positive pressure and a negative pressure using the two chambers.

12 Claims, 3 Drawing Sheets

PROCESS AND DEVICE FOR SUSPENDING HEAVY PARTICLES OF A SOLID IN A LIQUID

BACKGROUND OF THE INVENTION

The present invention relates to the suspending of particles of a solid in a predetermined volume of liquid. More particularly, the invention deals with the suspending, or re-suspending, of particles when they are contained in a container, with a predetermined volume of liquid, the particles being partially collected in the form of a deposit or sediment immersed by the liquid at the bottom of the container.

The particles/liquid physical state previously described and defined is encountered in particular in certain analysis protocols or processes, especially biological ones, involving relatively heavy particles, for example each consisting of a magnetic substrate to which, for example, a reagent or an analyte is bound. In order to implement or continue the analysis process, it is essential to suspend or re-suspend the particles in the predetermined volume of liquid inside the container, since failing this the particles which have sedimented are removed from the analysis process and vitiate its result in terms of reliability, sensitivity and reproducibility.

Until now, these particles have been suspended by mechanical or fluidic means, for example by passing a gas stream through the liquid volume in the container, close to or in contact with the deposit of sedimented particles. An operation of this type generally leads to the formation of foam, at the level of the interface between the liquid volume and the atmosphere internal to the container; it therefore has to be controlled carefully in order to limit, and if possible eliminate, the formation of foam which, in particular, hampers any subsequent optical measurement taken through the container. In all, this suspending or re-suspending of particles starting from a deposit at the bottom of a container, with everything in a predetermined volume of liquid, represents an intricate and relatively time-consiming operation.

SUMMARY OF THE INVENTION

The present invention therefore relates to a suspending process which is relatively "gentle" while remaining efficient, in so far as it does not significantly disturb the interface between the predetermined volume of liquid and the gas atmosphere contained in the container, for example an analysis cuvette.

According to the present invention, it has unexpectedly been discovered that the desired result can be obtained by setting up a gas circuit in the container, partly in direct contact with the liquid, in a loop comprising at least two substantially parallel flows which are separated by a head loss located level with the bottom of the container, and alternating a gas stream travelling through the said container along the said gas circuit.

Preferably, inert solid beads are arranged freely at the bottom of the container.

BRIEF DESCRIPTION OF THE DRAWINGS

The invention will be described in conjunction with the following drawings wherein.

DETAILED DESCRIPTION OF PREFERRED EMBODIMENT

Figure 1:
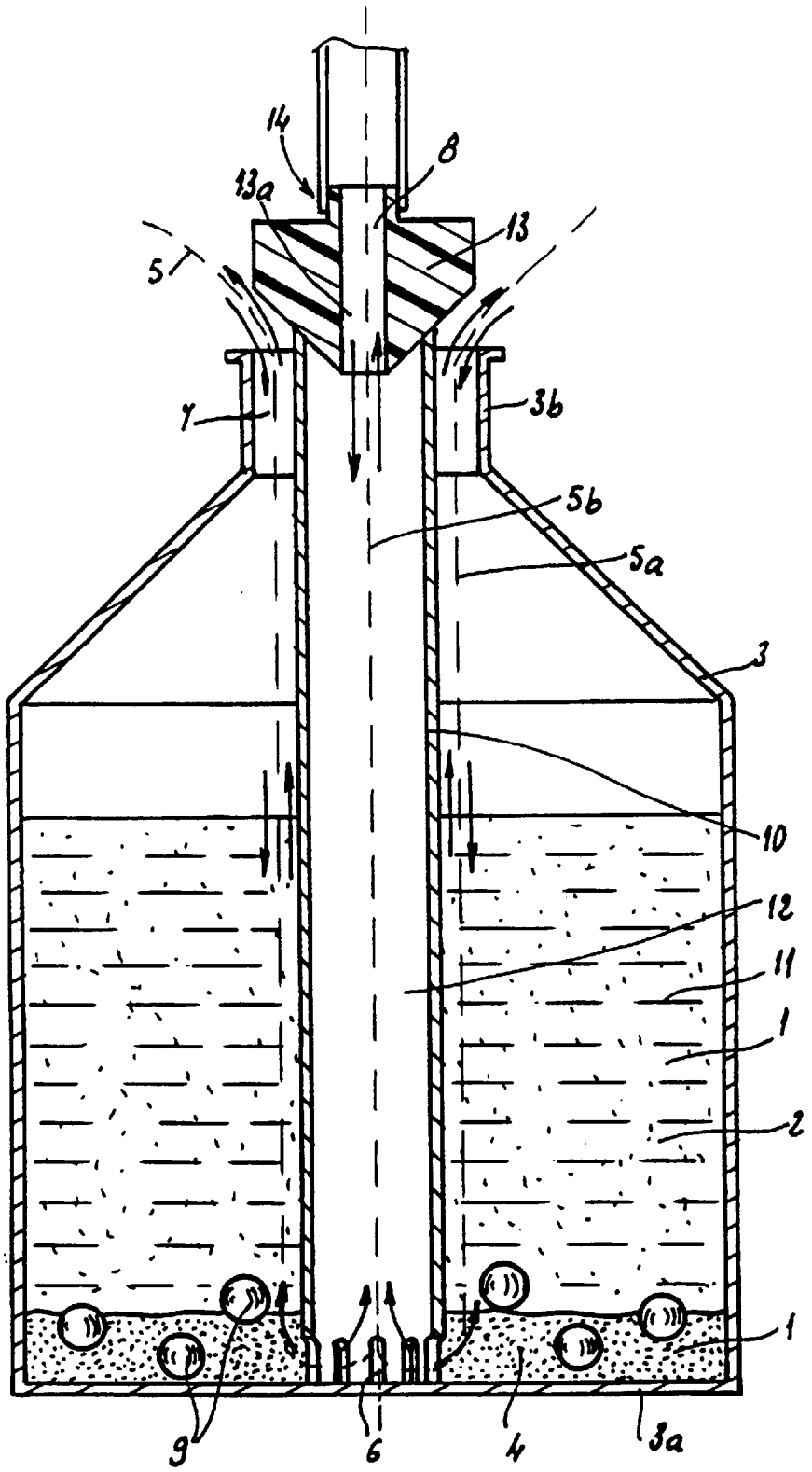
FIG. 1 is a vertical sectional view of the device according to the invention.

As shown in FIG. 1, the device according to the invention generally comprises:

- a container 3 for holding a predetermined volume 2 of liquid, and particles 1 of a solid which are normally dispersed inside the container, in the volume of liquid, for example an aqueous phase; this container 3 has a flat bottom 3*a* and a neck 3*b*
- at least one conduit 10 which is arranged and penetrates inside the container 3, one end of which emerges from the neck 3*b*, forming a tubular gap with the latter, and the perforated other end 6 of which is located level with and against the bottom 3*a* of the container, thus forming, as described below, a head loss localized between the lower periphery of the conduit 3 and the bottom 3*a* opposite
- a stopper 13 which closes off the upper end of the conduit 10 and in which an axial passage 13*a* is formed
- and solid inert beads 9 arranged freely on the bottom 3*a* of the container.

If necessary, the conduit 10/stopper 13 combination forms a component which is independent of the container 3 and can be introduced and extracted from the container 3, in order to suspend or re-suspend the particles 1 which will be discussed below.

The result of the structure or arrangement described above is that, in relation with the container 3, the conduit 10 defines two chambers 11 and 12, one which is external with respect to the conduit 10 and another which is internal to the conduit 10, communicating with one another through at least one gap or passage 6 which has been described above, level with the bottom 3*a* of the container 3, and which generates during operation the head loss which will be discussed below. These two chambers 11 and 12 communicate with the outside, respectively through the tubular gap 3, level with the neck 3*b*, and the opening 8 consisting of the axial channel 13*a* in the stopper 13. In this way, a gas circuit shown by the dot and dash line 5 can be set up in the container 3, passing through the opening 7, the chamber 11, the passage 6, the chamber 12 and the opening 8, or the reverse.

A means 14 of alternate pressurization is applied to the stopper 13, in relation with the opening 8, and makes it possible to set up a positive pressure then a negative pressure successively in the gas circuit 5 described above.

Irrespective of the relevant direction of the gas stream, the means 14 of alternate pressurization makes it possible for the circuit 5 shown by a dot and dash line in the single figure to be set up in the container 3, partly in direct contact with the liquid 2, in a loop or hair pin, comprising two substantially parallel flows 5*a* and 5*b* which circulate in the chambers 11 and 12 respectively and are separated by the head loss 6 located level with the bottom 3*a* of the container 3. Further, operation of the means 14 makes it possible to alternate the gas stream passing through the container 3 in the circuit 5 described above.

The gas circuit thus set up enters or leaves the container 3 through the two openings 7 and 8, each for inlet or outlet of the two flows 5*a* and 5*b* respectively, which are formed in the container 3 and are isolated from one another. During operation, the means 14 alternately applies a positive pressure then a negative pressure through the opening 8.

The following operating conditions or parameters may be considered:

- the head loss represents at least 10 mbar, and is preferably between 10 mbar and 500 mbar, and is for example between 50 mbar and 200 mbar the gas stream is alternated at a frequency at least equal to 3 Hz, and is preferably between 4 Hz and 25 Hz, for example between 5 Hz and 10 Hz.

EXAMPLE 1

Effect of the alternation frequency of the gas flow

Estapor M1 070/60 particles coated with alkaline phosphatase and diluted in an estradiol buffer (Tris NaCl Prionex 5 g/l) are re-suspended after one night of sedimentation at room temperature (concentration of the particles: 100 μg/ml). The frequencies applied are respectively 2.5 Hz and 11 Hz. The percentage re-suspended was obtained by negative weighing according to the document FR-A-2 710 410 using a Mettler AE 240 magnetic balance modified to the requirements of the experiment. The error connected with the accuracy of the measurement is + or −2%.

The results are presented in table 1 below and in the appended graph, according to FIG. 2, in which:

the ordinate represents the percentage re-suspended the abscissa represents the treatment time, expressed in seconds the black squares are assigned to the results obtained with a frequency of 2.5 Hz, and the white squares to the results obtained with a frequency of 11 Hz.

TABLE 1

| Re-suspension time in seconds. | Percentage re-suspended at a frequency of 2.5 Hz. | Percentage re-suspended at a frequency of 11 Hz. |
|---|---|---|
| 0 | 34.8 | 39 |
| 2 | 47.9 | 83.3 |
| 4 | 65.3 | 98.9 |
| 6 | 73.6 | 100* |
| 8 | 85.5 | 100* |
| 10 | 84.5 | 100* |

*indicates an error of + or − 2%.

Figure 2:
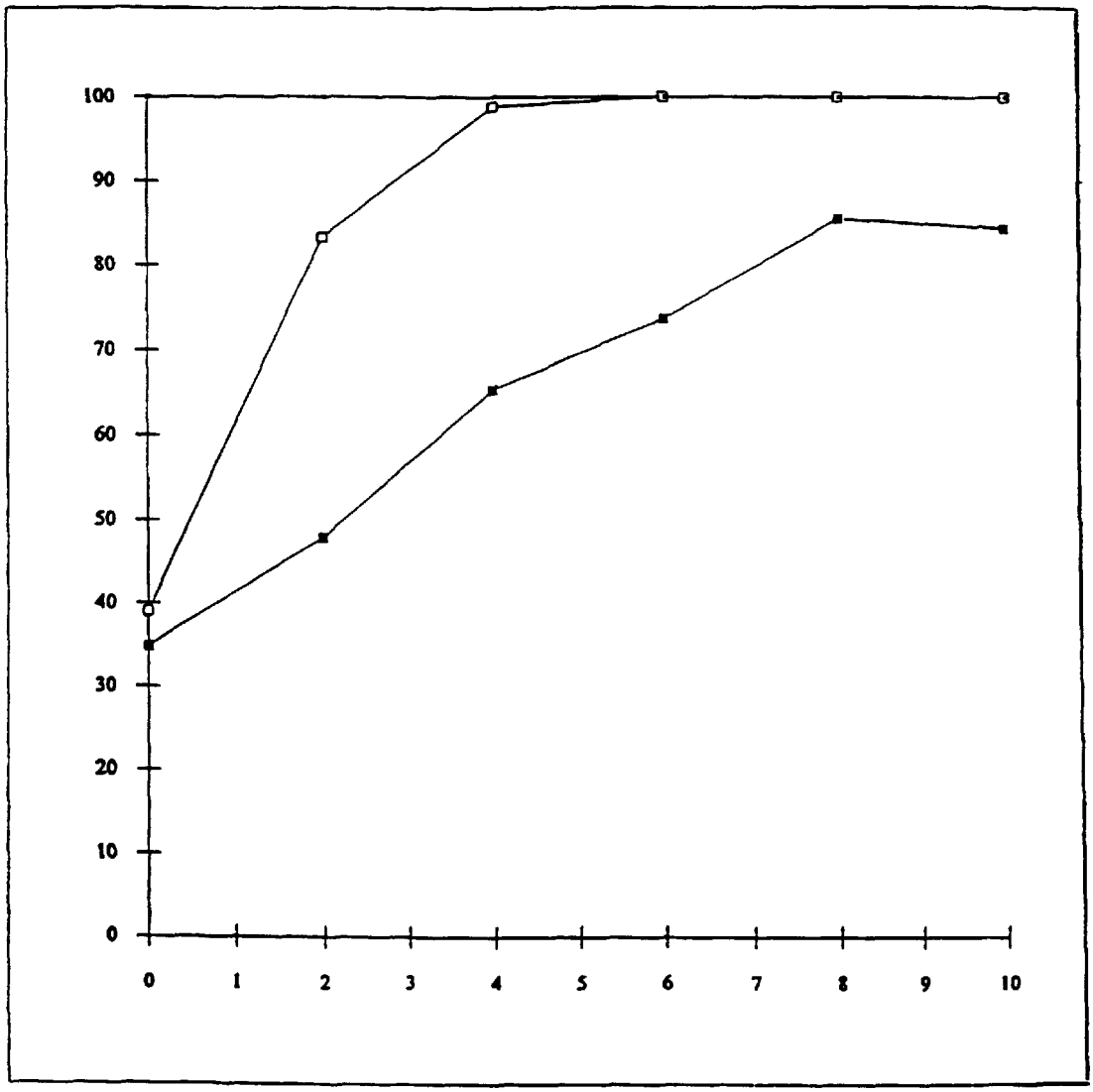
FIG. 2 is a graph depicting the results of a first experiment using the device shown in FIG. 1.

As shown by the above table and the appended graph according to FIG. 2 for a frequency of 11 Hz, the frequency plays an important role in the process of the invention. 100% re-suspension is obtained after an agitation time of at least 6 seconds at a frequency of 11 Hz, while it is impossible to obtain a homogeneous suspension, even after 10 seconds of agitation, at a frequency of 2.5 Hz.

EXAMPLE 2

Effect of the beads on the re-suspension

Seradyn C942339 particles coated with alkaline phosphatase and diluted in an estradiol buffer (Tris NaCl Prionex 5 g/l) were re-suspended after one month of sedimentation at a temperature of between 2 and 8° C. (concentration of the particles: 100 μ/ml). The frequency applied is 11 Hz. The percentage re-suspended was obtained by negative weighing according to patent FR-A-2 710 410 using a Mettler AE 240 magnetic balance modified to the requirements of the experiment. The error connected with the accuracy of the measurement is + or −2%.

The results are presented in Table 2 below and in the appended graph according to FIG. 3, in which:

the abscissa and ordinate express the same quantities and scales as those represented in FIG. 2 the black squares are assigned to the results without beads, and the white squares to the results with 5 mm glass beads.

TABLE 2

| Re-suspension time in seconds. | Percentage re-suspended without any beads. | Percentage re-suspended with 5 mm glass beads. |
|---|---|---|
| 0 | 0 | 0 |
| 2 | 81 | 100* |
| 4 | 93 | 100* |
| 6 | 100* | 100* |
| 8 | 100* | 100* |
| 10 | 100* | 100* |

*indicates an error of + or − 2%.

Figure 3:
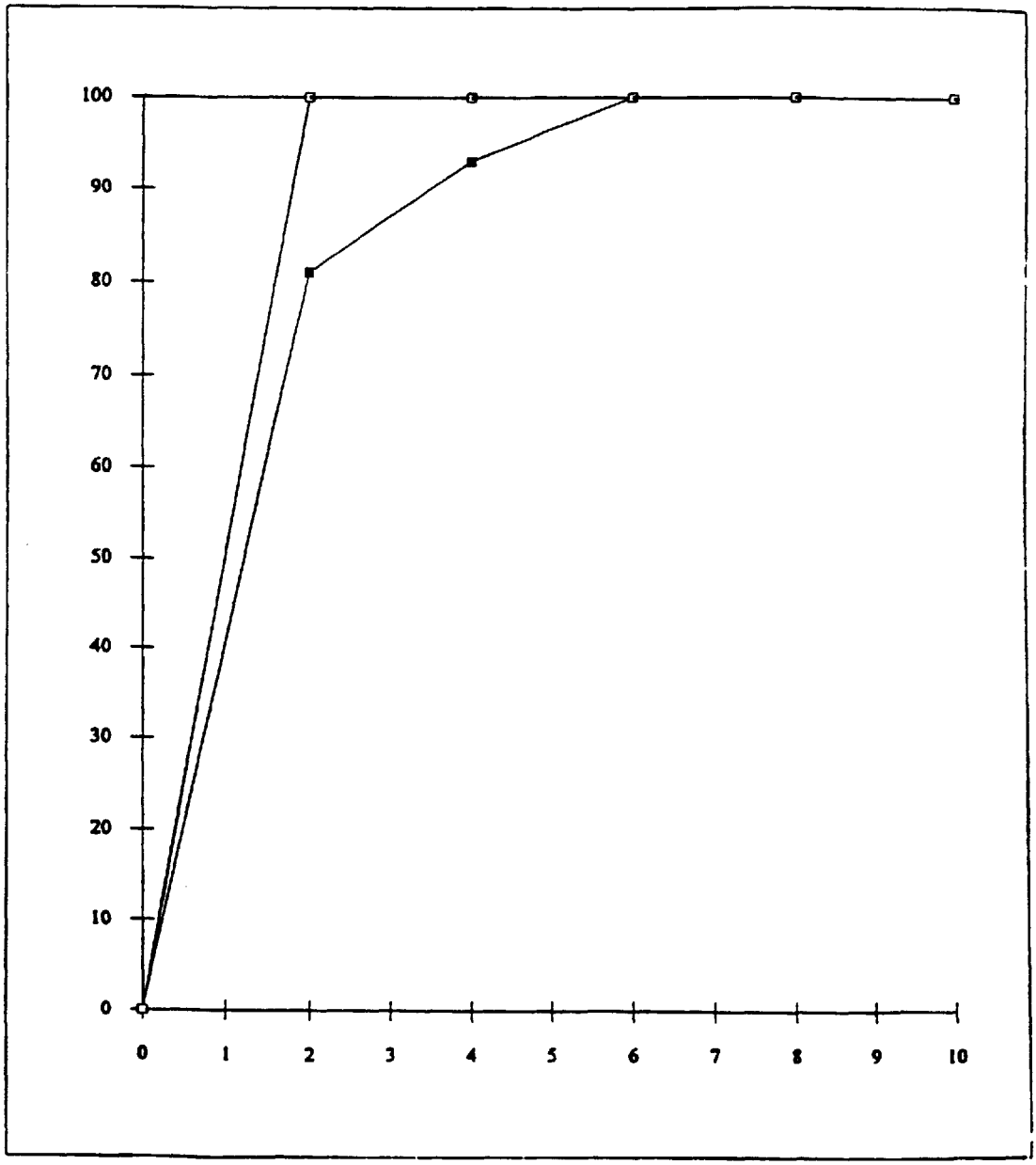
FIG. 3 is a graph depicting the results of a second experiment using the device shown in FIG. 1.

As shown by the above table and the appended graph according to FIG. 3, the addition of glass beads plays an essential role in the process of the invention. 100% re-suspension is obtained after an agitation time of at least 2 seconds at a frequency of 11 Hz in the presence of glass beads, while in the absence of glass beads it is possible to obtain a homogeneous suspension only after 6 seconds of agitation.

What is claimed is:

1. A method for suspending particles of a solid in a predetermined volume of liquid contained inside a container, the method comprising the following steps:

immersing the solid in the predetermined volume of liquid such that the particles of the solid are deposited on a flat bottom of the container as sediment;

establishing a gas circuit in the container in partial contact with the predetermined volume of liquid, the gas circuit forming a loop comprising at least two substantially parallel flows separated by a head loss located level with the flat bottom of the container; and alternating a direction of a gas stream traveling through the container along the gas circuit.

2. The method according to claim 1, wherein the gas circuit does one of enter and exit the container through two openings formed in the device for inlet or outlet of the two parallel flows respectively, the two openings being isolated from one another, and the method comprises the additional step of alternating a pressure applied to the gas circuit between one of a positive pressure and a negative pressure alternately through at least one of the two openings.

3. The method according to claim 1, wherein inert solid beads are dispersed freely at the flat bottom of the container.

4. The method according to claim 1, wherein the head loss is at least 10 mbar.

5. The method according to claim 4, wherein the head loss is less than 500 mbar.

6. The method according to claim 1, wherein the gas stream is alternated at a frequency at least equal to 3 Hz.

7. The method according to claim 1, wherein the gas stream is alternated at a frequency between 4 and 25 Hz.

8. A device for holding a predetermined volume of liquid and designed for suspending particles in the liquid, the device comprising:

a container providing a tapered neck and a flat bottom, the container holding a predetermined volume of the liquid;

at least one conduit disposed in the container, the conduit having a first end extending out of the tapered neck and a second end terminating at the flat bottom, the conduit defines two chambers communicating with each other through a first passage formed level with the flat bottom of the container and with the atmosphere outside of the container by at least two openings; and means of alternate pressurization for alternating a pressure in a gas circuit flowing through the device using the two chambers, the pressure alternating between one of a positive pressure and a negative pressure, the alternate pressurization means communicating with at least one of the two openings.

9. The device according to claim 8, wherein the conduit is a tube and the first passage formed level with the flat bottom is at least one gap between the flat bottom of the container and the second end.

10. The device according to claim 8, wherein a first opening between the neck and the first end of the conduit defines one of the two openings communicating with one of the two chambers.

11. The device according to claim 10, further comprising a stopper partially closing the first end of the conduit, the stopper having a second passage defining the other of the two openings in communication with the other of the two chambers.

12. The device according to claim 8, further comprising a plurality of inert solid beads freely dispersed at the flat bottom of the container.

* * * * *